United States Patent [19]

Dideriksen

[11] 4,176,493

[45] Dec. 4, 1979

[54] ROTATABLE ELEMENT FOR TOY BUILDING SETS

[75] Inventor: Erling T. Dideriksen, Billund, Denmark

[73] Assignee: Interlego A.G., Baar, Switzerland

[21] Appl. No.: 850,676

[22] Filed: Nov. 11, 1977

[30] Foreign Application Priority Data

Dec. 20, 1976 [DK] Denmark ..... 5736/76

[51] Int. Cl.[2] ..... A63H 33/06

[52] U.S. Cl. ..... 46/23; 46/25

[58] Field of Search ..... 46/23–25

[56] References Cited

U.S. PATENT DOCUMENTS

| | | | |
|---|---|---|---|
| 3,005,282 | 10/1961 | Christiansen | 46/25 |
| 3,233,358 | 2/1966 | Dehm | 46/25 |
| 3,236,004 | 2/1966 | Christiansen | 46/23 |
| 3,405,479 | 10/1968 | Paulson | 46/25 |
| 3,513,588 | 5/1970 | Fischer | 46/25 |

*Primary Examiner*—Louis G. Mancene

*Assistant Examiner*—Robert F. Cutting

*Attorney, Agent, or Firm*—Stevens, Davis, Miller & Mosher

[57] ABSTRACT

As a component for toy building sets there is provided a rotatable element comprising:

(a) a base plate (FIGS. 1, 2, 6 and 7) and (b) a disc (FIGS. 3, 4 and 5) pivotally mounted in a circular aperture in the base plate.

A socket for a pivot on the disc is located at the bottom of the base plate and is supported thereon by ribs integral with the socket and with four side walls at the bottom of the base plate.

Four identical apertures in the bottom of the base plate are formed by the socket, the ribs and the side walls.

Four engagement studs are provided on the top face of the disc and extend beyond the periphery thereof. The underface of these studs provides for slideable contact with the top face of the base plate during the rotation of the disc.

7 Claims, 7 Drawing Figures

ROTATABLE ELEMENT FOR TOY BUILDING SETS

This invention generally relates to toy building sets comprising a plurality of hollow box-shaped elements provided with engagement studs or projections of the kind specified in U.S. Pat. No. 3,005,282, and, more particularly, to a rotatable element of a similar kind as the turntable element described in U.S. Pat. No. 3,236,004, but which differs substantially from this prior art both as regards simplicity of the construction and the technical advantages afforded by the rotatable element according to the present invention.

One object of the invention is to provide a rotatable element which is suitable for mass production by injection moulding of thermoplastic or thermosetting materials.

Another object is to provide a rotatable element which comprises only two components, viz. a base plate and a disc provided with locking means of simple and inexpensive construction and which, moreover, serve as coupling means for connecting the rotatable element to adjacent elements in a toy building set of the kind referred to.

Other objects of the invention will appear from the following description of an embodiment of the invention with reference to the accompanying drawings.

Figure 3:
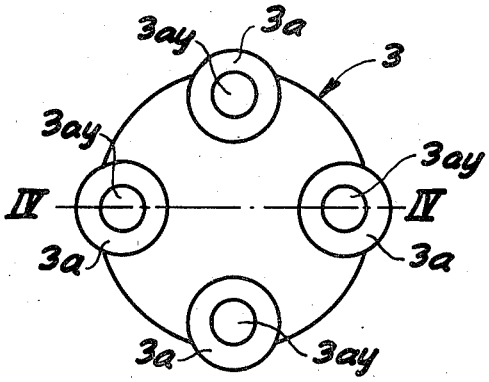
FIG. 3 is a plan view of the upper surface of the disc.
Figure 5:
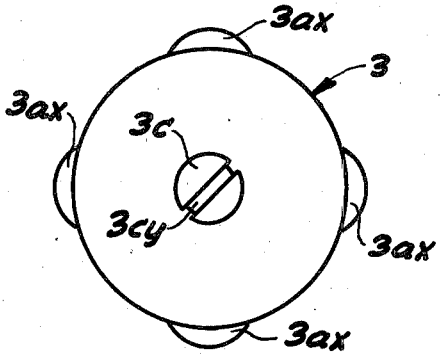
Figure 4:
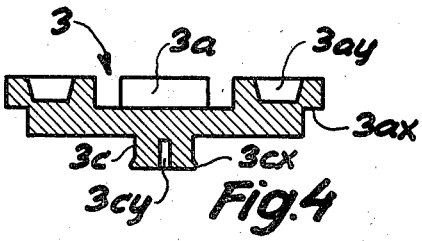
Figure 7:
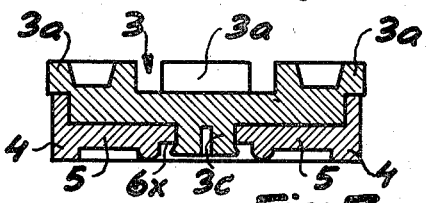
Figure 6:
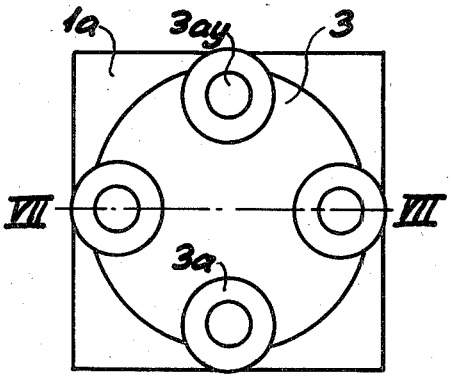

FIG. 4. is an axial section taken on the line IV—IV of FIG. 3,

FIG. 5 is a plan view of the underface of the disc,

FIG. 6 is a plan view of the top surface of the rotatable element with the disc mounted in the base plate, and FIG. 7 is an axial sectional view taken on the line VII—VII of FIG. 6.

Figure 1:
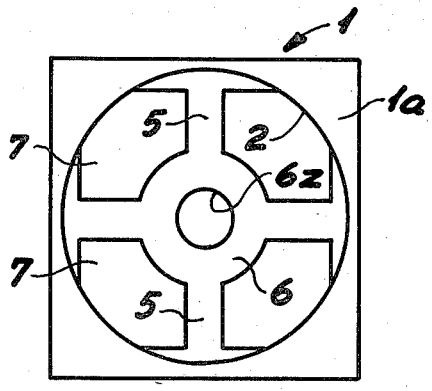
FIG. 1 is a plan view of the top surface of the base plate.
Figure 2:
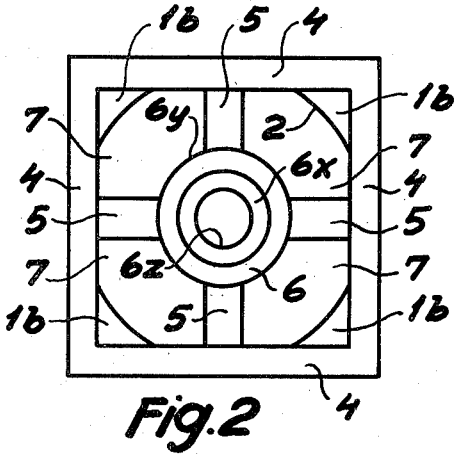
FIG. 2 is a plan view of the underface of the base plate.

In the embodiment shown in the drawings, the rotatable element comprises a square base plate 1, as shown in FIGS. 1 and 2, having an upper surface 1*a* and a circular aperture 2 therein adapted to receive a cylindrical disc 3, as shown in FIGS. 3, 4 and 5. The underface of the disc 3 is provided with a centrally disposed pivot 3*c* for pivotally mounting the disc 3 in a cylindrical bushing or socket 6 in the base plate.

The top face of the disc 3 is provided with four engagement studs 3*a* symmetrically disposed with respect to the centre of the disc adjacent the periphery thereof and extending beyond the periphery, so as to present bottom faces 3*ax* for slideable contact with the top face 1*a* of the base plate during the rotation of the disc.

The top faces of the engagement studs 3*a* may be provided with cylindrical recesses 3*ay* providing for saving of material during the moulding of the disc. Moreover, these recesses 3*ay* may also be adapted to receive coupling studs on an adjacent element pertaining to the building set, so as to provide for assembly of such elements with the disc 3.

As shown in FIGS. 4 and 5, the pivot 3*c* may be provided with a slit 3*cy* and a collar 3*cx* to form a snap lock for preventing axial displacement of the pivot 3*c* relatively to the socket in which it is pivotally mounted.

The arrangement of the socket 6 in the base plate will appear from FIGS. 1, 2 and 7.

As shown in FIG. 2, the base plate comprises a bottom face 1*b* which is integral with four side walls 4 defining a cavity. In this cavity, there is mounted a cylindrical bushing or socket 6 having a cylindrical bore 6*z* for pivotally mounting of the pivot 3*c*. The external cylindrical face 6*y* of the socket 6 is integral with four ribs 5 which are integral with the side walls 4 adjacent the middle thereof, so as to support the socket 6 in the cavity defined by said side walls. The annular bottom face of the socket is designated as 6*x* and is adapted to cooperate with the collar 3*cx* of the pivot 3*c* to provide for the snap locking effect, when the pivot is inserted in the bore, 6*z* with a slight deformation of the material owing to the slit 3*cy*.

As shown in FIG. 2, the bottom face 1*b* of the base plate together with the side walls 4, the ribs 5 and the outer cylindrical face 6*y* of the socket 6 define four identical sections 7 of the circular aperture 2 in the base plate, and the shape of these apertures is adapted so as to provide coupling means for clamping engagement studs on an adjacent element pertaining to the building set.

Thus, the rotatable element according to the invention provides for interrotatable connection of a pair of conventional building elements having engagement studs adapted, on the one hand, to be connected to the studs 3*a* on the disc 3 and, on the other hand, to be clamped in the apertures 7 of the base plate 1.

What I claim is:

1. A rotatable element for a toy building set, said element comprising:

a one-piece base plate having a circular aperture therein;

a one-piece rotatable member, said member comprising a disc of a diameter substantially equal to but slightly less than that of the circular aperture and positioned therein, said disc being rotatable in the circular aperture for rotational movement relative to the base plate;

said base plate comprising four side walls defining a cavity therebetween and a socket connected to the side walls, said socket being in the cavity coaxial with the circular aperture;

said rotatable member comprising a pivot post rotatably mounted in the socket and a plurality of engagement studs on the upper surface of the disc adjacent the periphery thereof, each of said studs extending partly beyond the periphery of the disc to slidably contact the top face of the base plate during rotation of the disc.

2. A rotatable toy element as claimed in claim 1, wherein:

said base plate is square and further comprises four ribs extending from the middle of said side walls to support the socket.

3. A rotatable toy element as claimed in claim 1, wherein the bottom of the base plate comprises four identical sections of the circular aperture, said sections being defined by the socket, the side walls of the base plate, the ribs interconnecting the socket with the side walls and the portions of the bottom face of the base plate disposed at the corners thereof adjacent the circular aperture therein, the shape of said sections defining coupling means for engagement studs on an adjacent element of the toy building set.

4. A rotatable toy element as claimed in claim 2, wherein:

said plurality of studs is four studs equally circumferentially spaced around the periphery of the disc.

5. A rotatable element for a toy building set, said element comprising two components:

(a) a substantially square one-piece base plate comprising a top face and a bottom face, a centrally disposed cylindrical aperture in the base plate, four side walls defining a cavity at the bottom face of the base plate, a socket in the cavity coaxially with the cylindrical aperture, and supporting means interconnecting the socket with the side walls; and (b) a one-piece rotatable element comprising a cylindrical disc pivotally mounted in the cylindrical aperture of the base plate for rotational movement relative thereto, said disc being of a diameter substantially equal to but slightly less than that of the circular aperture, said disc having a top face and a bottom face, said rotatable element comprising a pivot centrally disposed at the bottom face of the disc for pivotally mounting the disc in the socket of the base plate, said rotatable element further comprising four engagement studs on the top face of the disc adjacent the periphery thereof and substantially equally circumferentially spaced therearound so as to define a square, each of said studs extending beyond the periphery of the disc to slidably contact the top face of the base plate and prevent axial displacement of the disc relative to the base plate.

6. A rotatable element as claimed in claim 5, wherein said supporting means comprises four ribs extending from the middle of the side walls and interconnecting the side walls with the socket, said ribs being disposed at right angles relative to one another to define four identical sections of the cavity at the bottom of the base plate, the shape of said sections defining coupling means for engagement studs on an adjacent element of the toy building set.

7. A rotatable element for a toy building set, said element comprising:

a one-piece four-sided square base plate having a centrally disposed circular aperture therein, the four sides of said base plate defining a cavity therebetween, said base plate further comprising a socket connected to the sides, said socket being in the cavity coaxial with the circular aperture;

a one-piece rotatable member, said rotatable member comprising a disc of a diameter substantially equal to but slightly less than that of the circular aperture and positioned therein, said disc having a top surface and a bottom surface and being rotatable in the circular aperture for rotational movement relative to the base plate, said rotatable member further comprising a pivot post extending downwardly from the bottom surface of the disc, said post being rotatably mounted in the socket, said rotatable member further comprising four equally circumferentially spaced apart circular engagement studs, projecting upwardly from the upper surface of the disc adjacent the periphery thereof, each of said studs extending partly beyond the periphery of the disc for a distance substantially equal to that between the middle of the sides and the periphery of the disc to slidably contact the top face of the base plate during rotation of the disc and prevent axial displacement of the disc relative to the base plate.

* * * * *